US010279615B2

(12) United States Patent
Mizuta

(10) Patent No.: US 10,279,615 B2
(45) Date of Patent: May 7, 2019

(54) MARKING SYSTEM

(71) Applicant: Kobe Steel, Ltd., Hyogo (JP)

(72) Inventor: Yuichiro Mizuta, Takasago (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 15/875,128

(22) Filed: Jan. 19, 2018

(65) Prior Publication Data

US 2018/0229526 A1 Aug. 16, 2018

(30) Foreign Application Priority Data

Feb. 14, 2017 (JP) ..... 2017-025030

(51) Int. Cl.

| | |
|---|---|
| ***B41J 3/407*** | (2006.01) |
| ***B41J 2/23*** | (2006.01) |
| ***B41M 5/00*** | (2006.01) |
| ***B41M 5/03*** | (2006.01) |
| ***B41J 2/325*** | (2006.01) |

(52) U.S. Cl.

CPC ..... *B41M 5/0052* (2013.01); *B41J 2/325* (2013.01); *B41J 3/4073* (2013.01); *B41M 5/0094* (2013.01); *B41M 5/03* (2013.01); *B41J 2/23* (2013.01); *B41M 5/0064* (2013.01)

(58) Field of Classification Search

CPC . G01M 1/26; B65C 9/18; B65C 13/00; B65C 13/001; B44B 5/00; B44B 5/02; B41M 5/0052; B41M 5/03

See application file for complete search history.

(56) References Cited

U.S. PATENT DOCUMENTS

| | | | | |
|---|---|---|---|---|
| 6,568,320 | B2 * | 5/2003 | Wada | B41F 16/008 101/35 |
| 8,727,462 | B2 * | 5/2014 | Wakazono | B29D 30/0633 346/141 |
| 8,794,723 | B2 * | 8/2014 | Wakazono | B41J 2/325 346/141 |
| 2002/0005123 | A1 * | 1/2002 | Wada | B41F 16/008 101/33 |

(Continued)

FOREIGN PATENT DOCUMENTS

| | | | | |
|---|---|---|---|---|
| JP | HO 2012-181079 | * | 9/2012 | G01M 17/02 |
| JP | 5680447 | B2 | 3/2015 | |

(Continued)

*Primary Examiner* — Huan H Tran

(74) *Attorney, Agent, or Firm* — Studebaker & Brackett PC

(57) ABSTRACT

A marking system comprises plural marking heads disposed side-by-side in a horizontal direction, each of the marking heads performing printing on a surface of a tire by thermal transfer with a thermal transfer tape when the each of the marking heads is in proximity to the surface of the tire, air cylinders provided with the respective marking heads and moving the respective marking heads in proximity to the surface of the tire to make the respective marking heads perform printing, a linear actuator moving the marking heads and the air cylinders in the horizontal direction, and a controller selecting at least one of the marking heads and controlling the linear actuator to move the selected at least one of the marking heads to a position opposite the tire, thereby making the selected at least one of the marking heads perform printing.

4 Claims, 5 Drawing Sheets

(56) References Cited

U.S. PATENT DOCUMENTS

| | | | | |
|---|---|---|---|---|
| 2013/0229479 | A1* | 9/2013 | Wakazono | B29D 30/0633 347/197 |
| 2013/0335502 | A1 | 12/2013 | Wakazono | |
| 2016/0263233 | A1* | 9/2016 | Wang | C12N 5/0696 |
| 2016/0355061 | A1* | 12/2016 | Seimoto | B41J 17/02 |
| 2016/0366060 | A1* | 12/2016 | Fredette | G06F 15/167 |

FOREIGN PATENT DOCUMENTS

| | | | | |
|---|---|---|---|---|
| WO | WO 92/22795 | * | 12/1992 | B60C 13/001 |
| WO | WO 2012/117716 | * | 9/2012 | B41J 2/325 |

* cited by examiner

MARKING SYSTEM

BACKGROUND OF THE INVENTION

Field of the Invention

The present invention relates to a marking system for marking on tires after performance tests of the tires.

Description of the Related Art

The tires that have been tested for performance with tire testing machines are then marked by a marking system. As disclosed in JP 5680447 B2, the marking is undertaken by pressing a heated marking pin against a thermal transfer tape, followed by pressing the tape against a tire, thereby printing a desired mark on the tire by thermal transfer.

Now, there is generally a problem that identifying the mark shapes is difficult in the method of indicating the tire grades with a plurality of kinds of marks having the same color but different shapes in case that the thermal transfer has not been done properly. For instance, it is difficult to identify whether the original mark shape is a circle or a square when the central portion of a circular mark is missing due to inaccurate thermal transfer of the circular mark. Therefore, it has been desired to distinguish the tire grades by the mark colors rather than the mark shapes.

However, providing about two thermal transfer tapes with a marking head is the upper limit in view of the space available for the mechanism for feeding and winding the thermal transfer tapes in the marking system. Therefore, it is possible to selectively use two printing colors, but thermal transfer tapes have to be replaced in order to selectively use more than two print colors, and this is time consuming.

SUMMARY OF THE INVENTION

It is an object of the present invention to provide a marking system that is capable of selectively using a plurality of printing colors without replacing thermal transfer tapes.

A marking system according to a first aspect of the present invention includes: a plurality of marking heads disposed side-by-side in a horizontal direction, each of the marking heads performing printing on a surface of a tire by thermal transfer with at least one thermal transfer tape when the each of the marking heads is moved in proximity to the surface of the tire; devices for bringing close that are provided with the respective marking heads and move the respective marking heads in proximity to the surface of the tire when the respective marking heads perform printing; a moving unit horizontally moving the marking heads and the devices for bringing close; and a control device selecting at least one of the marking heads and controlling the moving unit to move the selected at least one of the marking heads to a position opposite the tire, thereby making the selected at least one of the marking heads perform printing.

According to the first aspect of the present invention, the at least one of the marking heads, selected among a plurality of the marking heads, is moved by the moving units to the position opposite the tire, and then performs printing; thereby a plurality of marking heads are selectively used. Accordingly, a plurality of the printing colors can be used by selectively using different marking heads associated with different printing colors. Hence, it is possible to selectively use plural printing colors without replacing the thermal transfer tapes.

DESCRIPTION OF THE PREFERRED EMBODIMENTS

In what follows, preferred embodiments of the present invention are described in reference to the drawings.

First Embodiment (Configuration of the Marking System)

Figure 1:
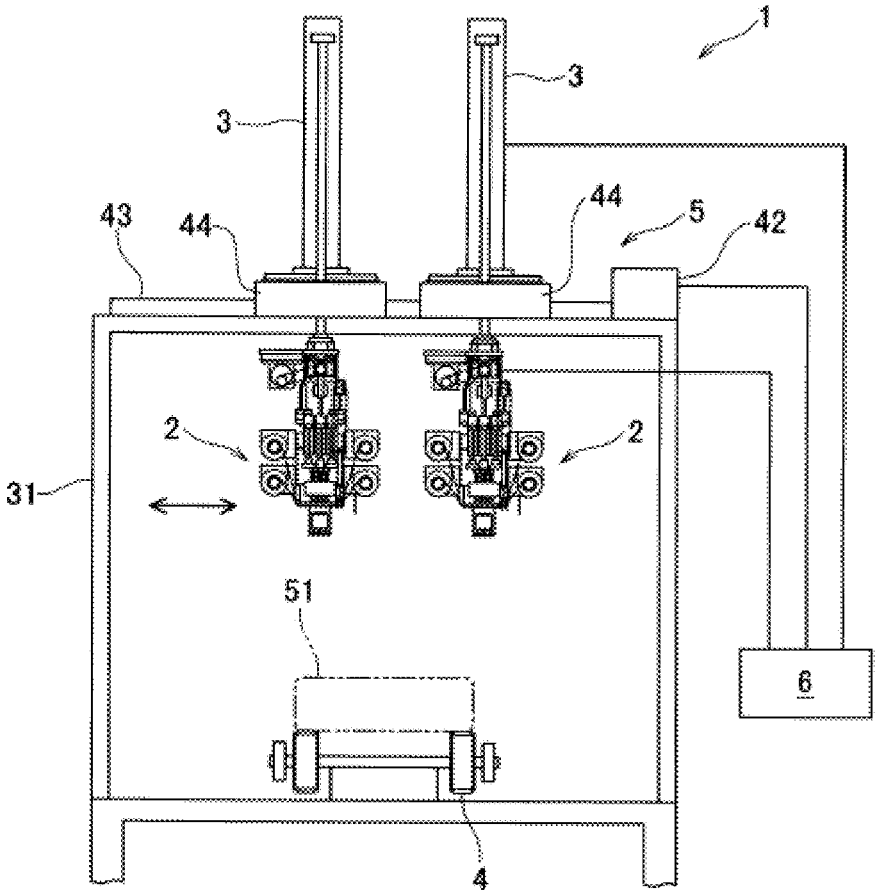
FIG. 1 illustrates a front view of a marking system.
Figure 2:
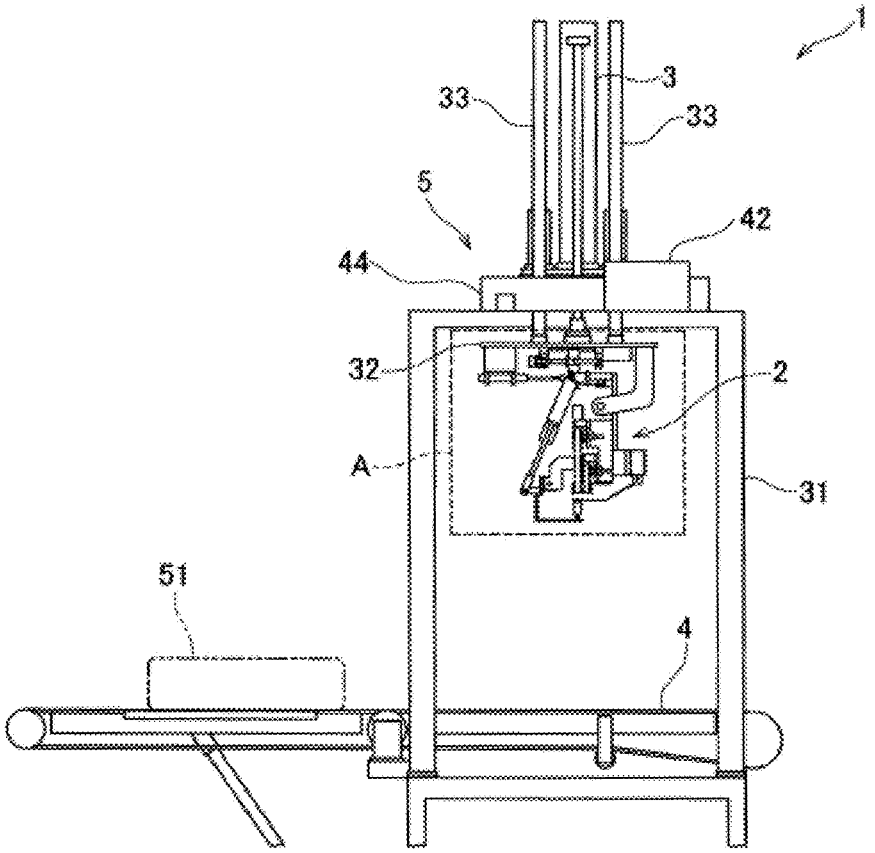
FIG. 2 illustrates a side view of the marking system.

A marking system 1 according to a first embodiment of the present invention comprises a plurality of marking heads 2, air cylinders (devices for bringing close) 3, a conveyor 4, a linear actuator (moving unit) 5, and a controller (control device) 6, as shown in FIG. 1 depicting the front view and in FIG. 2 depicting the side view. Note that a controller 6 is not depicted in FIG. 2.

(Conveyor)

After a tire 51 undergoes various performance tests by tire testing machines (not shown), the tire 51 is transferred onto the conveyor 4 by a center conveyor (not shown). The sidewall of the tire 51 faces upward on the conveyor 4. The conveyor 4 transfers the tire 51 in the horizontal direction. In FIG. 1, the transfer direction of the tire 51 is perpendicular to the plane of the drawing. A frame 31 is disposed on the sides and above the conveyor 4.

At the time of printing on the tire 51, the tire 51 is stopped at the printing position by the conveyor 4. The halt of the tire 51 at the printing position is appropriately done based on the transfer distance thereof by the conveyor 4. Specifically, a sensor (not shown) to detect the edge of the tire 51 is installed at a passing position of the conveyor, and the transferred position of the tire 51 is identified by evaluating how much distance the tire 51 has been transferred by the conveyor 4 after the tire 51 passed the sensor position. Also, the size of the tire 51 in the radial direction is distinguished by having the computer read information on the type of the transferred tire 51. Then the tire 51 is accurately positioned at the printing position based on information on the tire passing at the sensor position and on the radial direction of the tire as well as on the tire transfer distance by the conveyor 4.

(Marking Head)

A plurality of the marking heads 2 are disposed above the conveyor 4 to be arranged side-by-side in the horizontal direction. In the present embodiment, the number of the marking heads 2 is two, but it may be more than two. In FIG. 1, the aligned direction of the marking heads 2 is orthogonal to the transfer direction of tire 51 (the direction perpendicular to the plane of the drawing), but it may make a predetermined angle with the transfer direction. Each of the plurality of the marking heads 2 is supported by a lift frame 32, and disposed so as to vertically face the conveyor 4. A plurality of the marking heads 2 print the mark on the surface of tire 51 by thermal transfer with a thermal transfer tape when each of the marking heads is brought in proximity to the surface of the tire 51.

Figure 3:
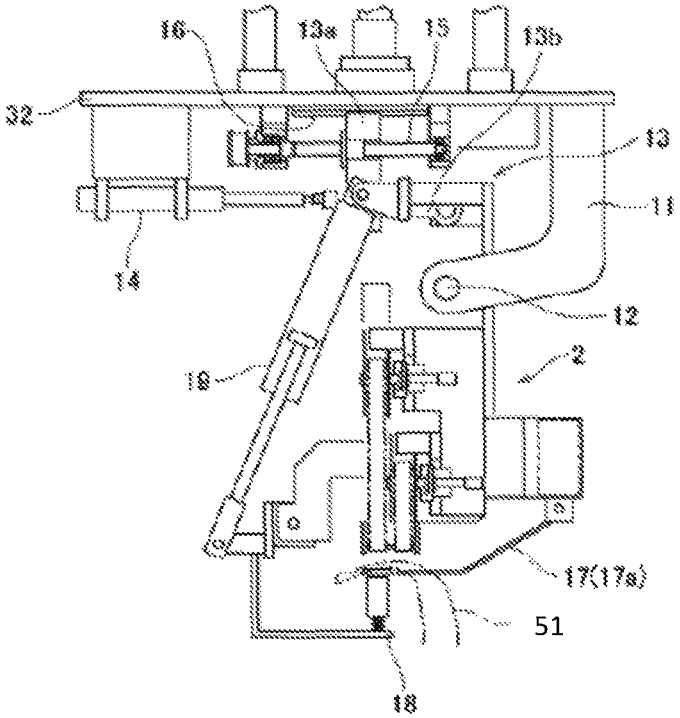
FIG. 3 illustrates an enlarged view of the main portion A of FIG. 2.

As shown in FIG. 3, an enlarged view of the main portion A of FIG. 2, the marking heads 2 are attached to a rotary shaft 12 bridged horizontally between a pair of nearly L-shaped supporting frames 11 that are fixed to the lift frame 32 in such a way that the marking heads 2 are swingable. Further, both an angle adjusting mechanism 13 to swing the marking heads 2 and a linear sensor 14 to measure the angle of the marking heads 2 are provided under the lift frame 32. The angle of the marking heads 2 is adjusted by the angle adjusting mechanism 13 so that it is suitable for printing on the tire 51.

The angle adjusting mechanism 13 comprises a movable body 13*a* horizontally moved along the transfer direction of the conveyor 4 and a link member 13*b* linking between the movable body 13*a* and the upper part of the marking head 2. The movable body 13*a* is screwed together with a ball screw 15, and a motor (not shown) rotates the ball screw 15, so that the movable body 13*a* is horizontally moved along a guide 16.

In such a configuration, when the movable body 13*a* is moved to the right in the figure, the upper part of the marking head 2 is moved to the right by the link member 13*b*. Accordingly, the marking head 2 rotates clockwise with the rotary shaft 12 as a fulcrum, and hence the lower part of the marking head 2 swings toward the upper left. Similarly, when the movable body 13*a* is moved to the left in the figure, the upper part of the marking head 2 is moved to the left by the link member 13*b*. Accordingly, the marking head 2 rotates counterclockwise with the rotary shaft 12 as a fulcrum, and the lower part of the marking head 2 swings toward the upper right. The angle of the marking head 2 is measured by the linear sensor 14; thereby the angle of the marking head 2 is adjusted at the angle suitable for printing.

In addition, a tire contact switch 17 is provided at the lower part of the marking head 2 to detect the contact with the tire 51. The tire contact switch 17 consists of a rod-shaped body 17*a* and a limit switch (not shown), and the limit switch is actuated on the base-end side when the tip-end side of the rod-shaped body 17*a* has touched the tire 51. Once the limit switch is actuated, braking is applied to the air cylinders 3 (see below), forming an appropriate gap between the tire 51 and the marking head 2.

Furthermore, installed under the marking head 2 is a support 18 that is allowed to rotate and prevents the tire 51 from being dented by holding the back side of the tire 51 when marking pins 21*a*, 21*b*, and 21*c* (see below) are pushed down on the tire 51. The support 18 is rotationally driven by an air cylinder 19 attached to the marking head 2 so that the rod of the air cylinder 19 faces downward.

Figure 4:
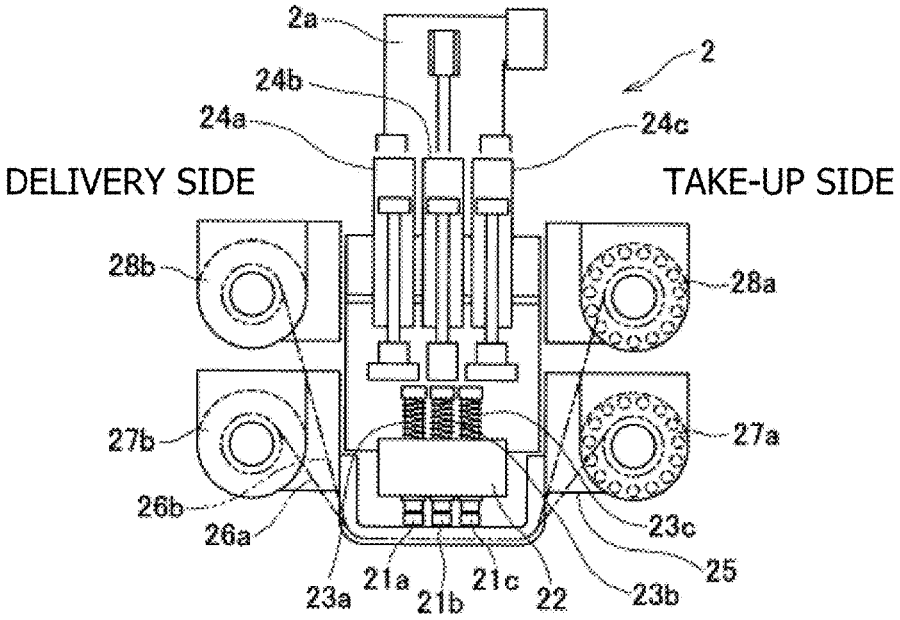
FIG. 4 illustrates a partially enlarged view of FIG. 1.

As shown in FIG. 4 that is a partially enlarged view of FIG. 1, the marking head 2 includes a main plate 2*a*. The main plate 2*a* is provided with the three marking pins 21 (21*a*, 21*b*, and 21*c*) and a heater (not shown) to heat the marking pins 21*a*, 21*b*, and 21*c*.

The marking pins 21*a*, 21*b*, and 21*c* are movable in the longitudinal direction, and their ends are machined in a shape such as a circle or a triangle, depending on the shape to be printed. The heater heats the marking pins 21*a*, 21*b*, and 21*c* by heating the block 22 through which the marking pins 21 (21*a*, 21*b*, and 21*c*) extend. The temperature of the marking pins 21*a*, 21*b*, and 21*c* is controlled by the heater to be suitable for the thermal transfer tapes 26*a* and 26*b* described below.

In addition, air cylinders 24*a*, 24*b*, and 24*c* are installed on the main plate 2*a*. The air cylinders 24*a*, 24*b*, and 24*c* push out the corresponding marking pins 21*a*, 21*b*, and 21*c* toward the thermal transfer tapes 26*a* and 26*b*, which face the marking pins 21*a*, 21*b*, and 21*c*, by extending the rods, and hence push the marking pins 21*a*, 21*b*, and 21*c* to the thermal transfer tapes 26*a* and 26*b*. Then, one of the air cylinders 24*a*, 24*b*, or 24*c* that meets the printing conditions is actuated.

Coil springs 23*a*, 23*b*, and 23*c* are disposed to be extensible between the upper end of the marking pins 21*a*, 21*b*, and 21*c* and the block 22. The marking pins that have been pushed out toward the thermal transfer tapes 26*a* and 26*b* by the extension of the rods of the air cylinders are moved back to the original positions by the coil springs as the rods are retracted.

Also, the marking head 2 includes a supporting base 25 to support the two thermal transfer tapes 26*a* and 26*b*. The thermal transfer tapes 26*a* and 26*b* are the tapes coated with inks that are transferred to the transfer target by heating. The supporting base 25 supports the two thermal transfer tapes 26*a* and 26*b* so as to align them in the direction perpendicular to the plane of the drawing.

The supporting base 25 is provided with a delivery reel 27*a* to feed the thermal transfer tape 26*a* and a take-up reel 27*b* to wind the thermal transfer tape 26*a*. In addition, the supporting base 25 is provided with a delivery reel 28*a* to feed the thermal transfer tape 26*b* and a take-up reel 28*b* to wind the thermal transfer tape 26*b*. The take-up reel 27*b* and the take-up reel 28*b* are rotated by a motor (not shown).

The supporting base 25 is moved in the direction perpendicular to the plane of the drawing by air cylinders (not shown) installed on the main plate 2*a*. Consequently, one of the two thermal transfer tapes 26*a* and 26*b* is arranged facing the marking pins 21*a*, 21*b*, and 21*c*. Namely, the thermal transfer tapes 26*a* and 26*b* to be used can be switched by moving the supporting base 25. Note that the thermal transfer tapes 26*a* and 26*b* carried by the marking head 2 are not necessarily limited to two tapes, but may be more than two tapes.

Note also that in the present embodiment, both of the two marking heads 2 are configured to carry two thermal transfer tapes 26*a* and 26*b* and to be switchable between the thermal transfer tapes to be used, but either one of the two marking heads 2 may be configured to be able to switch the thermal transfer tapes to be used while the other uses only a single thermal transfer tape.

(Air Cylinder)

Returning to FIG. 1, the air cylinders 3 are provided for respective marking heads 2. The air cylinders 3 are installed on respective movable members 44 (see below) on the frame 31. The air cylinders 3 vertically move the marking heads 2 by lifting up or lowering down the lift frame 32. The air cylinder 3 makes the corresponding marking head 2 move in proximity to the surface of the tire 51 when the corresponding marking head 2 performs printing.

As shown in FIG. 2, guide members 33 for guiding the lifting-up and lowering-down of the lift frame 32 are provided on the movable member 44 at the front and the rear of the air cylinders 3 in the transfer direction of the conveyor 4.

(Linear Actuator)

Figure 5:
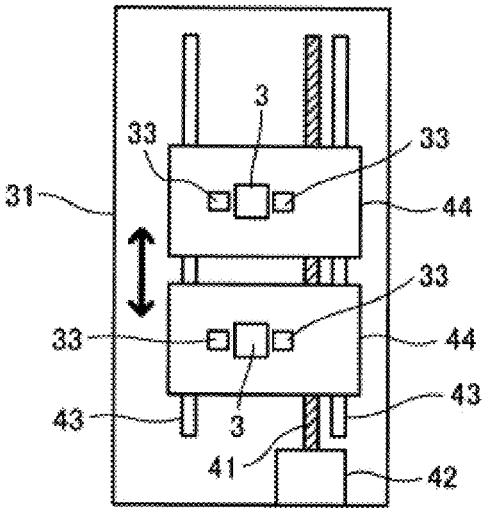
FIG. 5 illustrates a top view of the marking system.

As shown in FIG. 1 and FIG. 2, a linear actuator 5 is disposed on the frame 31. As shown in FIG. 5, a top view of the marking system 1, the linear actuator 5 comprises a ball screw 41, a motor 42 to rotate the ball screw 41, a pair of guide members 43, and the movable members 44.

The ball screw 41 extends in parallel to the direction in which a plurality of the marking heads 2 are aligned. The guide members 43 is fixed on the frame 31, and disposed on respective sides of the ball screw 41 to extend in parallel to the ball screw 41. The movable members 44 are provided for the respective marking head 2, screwed together with the ball screw 41, and engaged with a pair of the guide members 43. As described above, both the air cylinder 3 and the guide member 33 are installed on the movable member 44.

In such a configuration, when the ball screw 41 is rotated by the motor 42, a plurality of the movable members 44 are moved in the horizontal direction while keeping a constant distance between them. As the movable members 44 move horizontally, the marking heads 2 and the air cylinders 3 are moved in the horizontal direction.

(Controller)

The controller 6 controls each of a plurality of the marking heads 2, each of a plurality of the air cylinders 3, and the linear actuator 5. The controller 6 selects one of the marking heads 2 for printing on the tire 51 according to the printing conditions. Also, the controller 6 selects one of the thermal transfer tapes 26*a* and 26*b* carried by the marking head 2 according to the printing conditions. Then, the controller 6 controls the linear actuator 5 to move the selected marking head 2 to the position opposite the tire 51. And the controller 6 makes the marking head 2 perform printing with a selected thermal transfer tape by controlling the air cylinders 3 and the marking head 2.

As described above, the controller 6 first selects one of the marking heads 2 and then controls the linear actuator 5 to move the selected marking head 2 to the position opposite the tire 51, thereby making the selected marking head 2 perform printing. By this procedure, a plurality of marking heads 2 can be selectively used. Thus, a plurality of printing colors can be selectively used if different printing colors are set for different marking heads 2 and the marking heads 2 are selectively used. It is thus possible to selectively use a plurality of the printing colors without replacing the thermal transfer tapes 26*a* and 26*b*.

Further, the printing is performed with either one of the thermal transfer tapes 26*a* and 26*b* carried by the selected marking head 2. Accordingly, it is possible to selectively use the plural thermal transfer tapes 26*a* and 26*b*. Therefore, plural printing colors can be selectively used if different printing colors are set for the thermal transfer tapes 26*a* and 26*b* and the thermal transfer tapes 26*a* and 26*b* are selectively used. This makes it possible to selectively use more kinds of the printing colors without replacing the thermal transfer tapes 26*a* and 26*b*.

Modified Example

The unit to horizontally move the marking heads 2 and the air cylinders 3 is not limited to the linear actuator 5 including the ball screw 41 and the motor 42, and it may be air cylinders and the like.

(Effects of Invention)

As described above, according to the marking system 1 of the present embodiment, the marking head 2 selected from the plural marking heads 2 is moved by the linear actuator 5 to the position opposite the tire 51, and it performs printing. In this way, a plurality of marking heads 2 can be selectively used. Thus, a plurality of printing colors can be selectively used if different printing colors are set for different marking heads 2. It is thus possible to selectively use plural printing colors without replacing the thermal transfer tapes 26*a* and 26*b*.

Further, the printing is performed by one of the thermal transfer tapes 26*a* and 26*b* when the marking head 2 carrying the thermal transfer tapes 26*a* and 26*b* is selected. In this way, the thermal transfer tapes 26*a* and 26*b* can be selectively used. Therefore, a plurality of the printing colors can be selectively used if different printing colors are set for the thermal transfer tapes 26*a* and 26*b*, and the thermal transfer tapes 26*a* and 26*b* are selectively used. This makes it possible to selectively use more kinds of the printing colors without replacing the thermal transfer tapes 26*a* and 26*b*.

Second Embodiment

Next, a marking system according to a second embodiment will be described in reference to the drawings. Note that in the following, the description of the configurations common to the first embodiment and the effects exerted thereby are omitted, and the points different from the first embodiment are described. Note also that the same reference numbers as in the first embodiment are used for the same members as in the first embodiment.

(Configuration of the Marking System)

Figure 6:
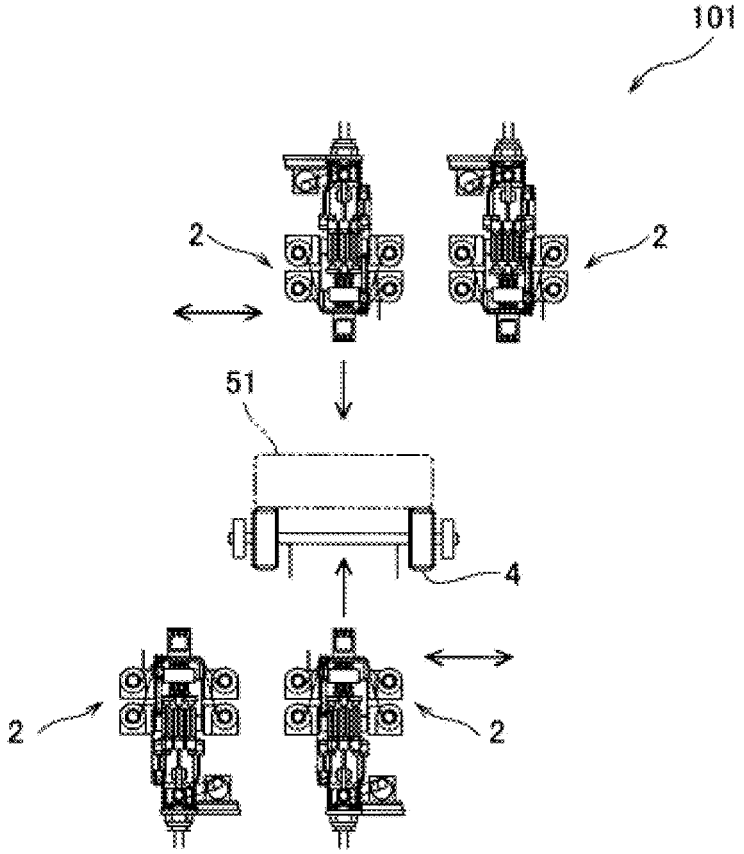
FIG. 6 illustrates a front view of another marking system.

As shown in FIG. 6, the front view, a marking system 101 of the present embodiment has a plurality of the marking heads 2 not only above the tire 51 but also below the tire 51. A plurality of the marking heads 2 are disposed in parallel to each other in the horizontal direction below the tire 51. The configuration of the marking heads 2 installed below the tire 51 is the same as that of the marking heads 2 installed above the tire 51. Note that in FIG. 6, the illustrations are omitted except for the marking head 2 and the conveyor 4.

In the present embodiment, the number of the marking heads 2 installed below the tire 51 is two, but it may be more than two. In FIG. 6, the aligned direction of a plurality of the marking heads 2 provided below the tire 51 is orthogonal to the transfer direction of the tire 51 (the direction perpendicular to the plane of the drawing), but it may make a predetermined angle with the transfer direction.

The marking heads 2 installed below the tire 51 are supported by the lift frame in a manner similar to the marking heads 2 installed above the tire 51, and are vertically moved by the air cylinders. The marking heads 2 installed above the tire 51 performs printing on the upper surface of the tire 51 whereas the marking heads 2 installed below the tire 51 performs printing on the lower surface of the tire 51.

Similarly, a plurality of the marking heads 2 and the air cylinders, both of which are installed below the tire 51 are horizontally moved by the linear actuator in a manner similar to the marking heads 2 and the air cylinders 3, both of which are installed above the tire 51.

The controller 6 (see FIG. 1) selects one of a plurality of the marking heads 2 installed above the tire 51 and a plurality of the marking heads 2 installed below the tire 51 according to the printing conditions, and makes the selected marking head 2 perform printing on the tire 51. Also, the controller 6 selects either one of the thermal transfer tapes 26*a* and 26*b* that are carried by the marking head 2, and makes the selected marking head 2 perform printing with the selected thermal transfer tape.

In such a way, a plurality of the marking heads 2 are disposed above and below the tire 51 to be arranged side-by-side in the horizontal direction. Therefore, more marking heads 2 can be selectively used by making the selected marking head 2 perform printing in comparison with the configuration in which a plurality of the marking head 2 are installed only above or below the tire 51. This means that more print colors can be selectively used if different printing colors are set for the marking heads 2.

The number of thermal transfer tapes 26*a* and 26*b* carried by a marking head 2 is two. Accordingly, maximum eight colors can be selectively used by installing two marking heads 2 above and below the tire 51.

Note that the configuration of the controller 6 is not restricted only to the configuration in which one of the plural marking heads 2 installed above the tire 51 and the plural marking heads 2 installed below the tire 51 is selected. The controller 6 may select one of a plurality of the marking heads 2 installed above the tire 51 according to the printing conditions and also select one of a plurality of the marking heads 2 installed below the tire 51, and make each of the selected two marking heads 2 perform printing independently.

In the above case, any one of a plurality of the marking heads 2 installed above the tire 51 and any one of a plurality of the marking heads 2 installed below the tire 51 can be used in combination. Thus, a plurality of the printing patterns can be selectively used by combining the printing on the upper surface of the tire 51 and the printing on the lower surface of the tire 51.

The number of the printing patterns with only the two marking heads 2 installed above the tire 51 is four at the maximum. Also, the number of the printing patterns with only the two marking heads 2 installed below the tire 51 is four at the maximum. Accordingly, the number of printing patterns with the combination of the four thermal transfer tapes above the tire 51 and the four thermal transfer tapes below the tire 51 is sixteen at the maximum. Consequently, twenty-four printing patterns can be selectively used at the maximum.

Note that the printing on the upper surface of the tire 51 and the printing on the lower surface of the tire 51 may be performed at the same time or at different times.

(Effects of Invention)

As stated above, according to the marking system 101 of the present embodiment, a plurality of the marking heads 2 are disposed above and below the tire 51 to be arranged side-by-side in the horizontal direction. Thus, more marking heads 2 can be selectively used by making the selected marking head 2 perform printing as compared with the configuration in which a plurality of the marking heads 2 are installed only above or below the tire 51. Hence, more printing colors can be selectively used if different printing color is set for each of the marking heads 2.

Further, any one of a plurality of the marking heads 2 installed above the tire 51 and any one of a plurality of the marking heads 2 installed below the tire 51 may be used in combination. Thus, a plurality of the printing patterns can be selectively used by combining the printing on the upper surface of the tire 51 and the printing on the lower surface of the tire 51.

The embodiments of the present invention have been described above, but they are only specific examples of the present invention, and hence the present invention is not restricted by the embodiments at all. It should be emphasized that the specific configurations and the like are allowed to be appropriately changed and redesigned. Moreover, the functions and the effects described in the embodiments of the present invention explain merely the most preferable functions and effects resulting from the present invention, and the functions and the effects of the present invention are not restricted within the embodiments of the present invention.

What is claimed is:

1. A marking system, comprising:

a plurality of marking heads disposed side-by-side in a horizontal direction, each of the marking heads carries a plurality of thermal transfer tapes, each thermal transfer tape having a color, and performs printing on a surface of a tire by thermal transfer with the thermal transfer tapes when the each of the marking heads is moved in proximity to the surface of the tire;

a plurality of air cylinders that are provided with the respective marking heads and move the respective marking heads in proximity to the surface of the tire when the respective marking heads perform printing;

a linear actuator horizontally moving the marking heads and the plurality of air cylinders; and a controller selecting at least one of the marking heads and controlling the linear actuator to move the selected at least one of the marking heads to a position opposite the tire, thereby making the selected at least one of the marking heads perform printing, wherein at least one of the thermal transfer tapes on a first of the marking heads has a color that is different from each color of the thermal transfer tapes on a second of the marking heads.

2. The marking system according to claim 1, wherein:

each of the plurality of the marking heads is switchable between the thermal transfer tapes to be used; and the controller selects the at least one of the marking heads carrying the plurality of thermal transfer tapes, and makes the at least one of the marking heads perform printing with any one of the thermal transfer tapes.

3. The marking device according to claim 1, wherein a plurality of the marking heads is disposed above and below the tire to be arranged side-by-side in the horizontal direction.

4. The marking device according to claim 2, wherein a plurality of the marking heads is disposed above and below the tire to be arranged side-by-side in the horizontal direction.

* * * * *